US008242921B2

(12) United States Patent
Yang

(10) Patent No.: US 8,242,921 B2
(45) Date of Patent: Aug. 14, 2012

(54) MULTIFUNCTIONAL PORTABLE ELECTRONIC DEVICE AND METHOD FOR USING THE SAME

(75) Inventor: Sheng-Hsiung Yang, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 438 days.

(21) Appl. No.: 12/555,054

(22) Filed: Sep. 8, 2009

(65) Prior Publication Data

US 2010/0148974 A1 Jun. 17, 2010

(30) Foreign Application Priority Data

Dec. 16, 2008 (CN) ..... 2008 1 0306291

(51) Int. Cl.
*G08B 17/10* (2006.01)

(52) U.S. Cl. ..... 340/628; 340/627; 340/632

(58) Field of Classification Search ..... 340/628
See application file for complete search history.

(56) References Cited

U.S. PATENT DOCUMENTS

| | | | | |
|---|---|---|---|---|
| 5,999,094 | A * | 12/1999 | Nilssen | 340/507 |
| 7,804,522 | B2 * | 9/2010 | Haynes | 348/208.15 |
| 2006/0164241 | A1 * | 7/2006 | Makela et al. | 340/556 |
| 2007/0188336 | A1 * | 8/2007 | Privalov | 340/628 |
| 2008/0045156 | A1 * | 2/2008 | Sakhpara | 455/67.11 |
| 2008/0186191 | A1 * | 8/2008 | Shen-Kuen et al. | 340/628 |
| 2008/0303678 | A1 * | 12/2008 | McCredy | 340/628 |
| 2009/0027499 | A1 * | 1/2009 | Nicholl | 348/158 |

FOREIGN PATENT DOCUMENTS

CN 1349091 A 5/2002

* cited by examiner

*Primary Examiner* — George Bugg
*Assistant Examiner* — Kerri McNally
(74) *Attorney, Agent, or Firm* — Altis Law Group, Inc.

(57) ABSTRACT

A portable electronic device includes an image capturing unit, a processor unit connected to the image capturing unit, and an alarm unit connected to the processor unit. The image capturing unit captures outside images, the processor unit detects if there is any smoke near the portable electronic device according to the images and measuring relative parameters of detected smoke, and the alarm unit alarms when at least one parameter of detected smoke is out of predetermined acceptable ranges.

16 Claims, 2 Drawing Sheets

MULTIFUNCTIONAL PORTABLE ELECTRONIC DEVICE AND METHOD FOR USING THE SAME

CROSS-REFERENCE TO RELATED APPLICATIONS

This application is related to a co-pending U.S. patent application Ser. No. 12/557,692, entitled "MULTIFUNCTIONAL PORTABLE ELECTRONIC DEVICE WITH AN INTEGRATED SMOKE ALARM FEATURE AND ALARMING METHOD THEREOF", by Hsiao-Chun Liu. This application has the same assignee as the present application. The above-identified application is incorporated herein by reference.

BACKGROUND

1. Technical Field

The present disclosure relates to multifunctional portable electronic devices and methods for using the same, and particularly to a portable electronic device capable of detecting smoke and a method for using the same.

2. Description of Related Art

Nowadays, smoke detectors are widely used for providing fire alarm. However, most conventional smoke detectors are fixed in predetermined positions. These fixedly installed smoke detectors generally spend much cost and are not capable of being carried by the users to detect smoke at any moment and anywhere. Additionally, the conventional smoke detectors usually need wires or cables connected thereto to transmit data. If the wires of cables are damaged in fire, the smoke detectors may fail to function.

Therefore, there is room for improvement within the art.

BRIEF DESCRIPTION OF THE DRAWINGS

Many aspects of the present portable electronic device and method for using the same can be better understood with reference to the following drawings. The components in the various drawings are not necessarily drawn to scale, the emphasis instead being placed upon clearly illustrating the principles of the present portable electronic device and method for using the same. Moreover, in the drawings, like reference numerals designate corresponding parts throughout the figures.

DETAILED DESCRIPTION

Figure 1:
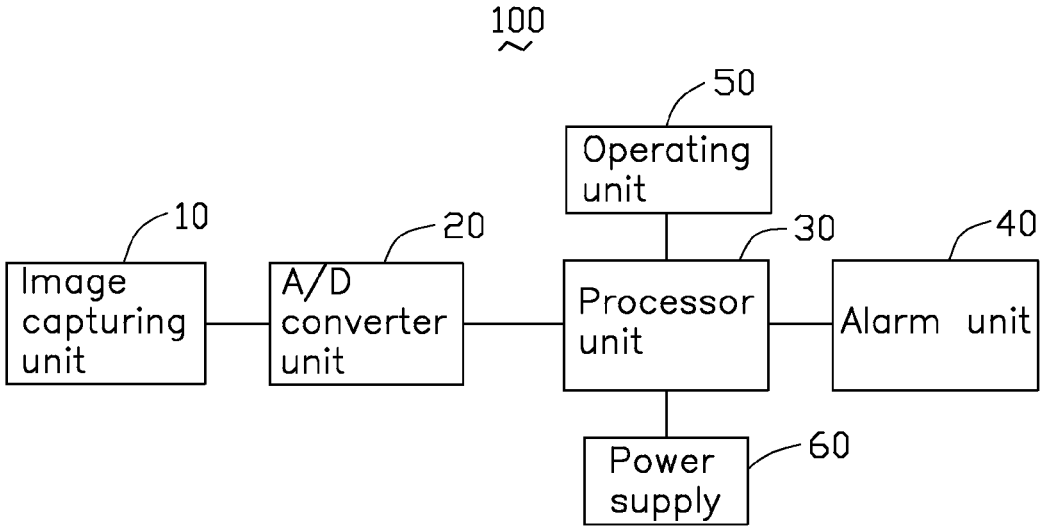
FIG. 1 is a block diagram of a portable electronic device, according to an exemplary embodiment.

Referring to FIG. 1, a portable electronic device 100 according to an exemplary embodiment is shown. The portable electronic device 100 can be a mobile phone, a personal digital assistant (PDA), a laptop computer, etc. The portable electronic device 100 includes an image capturing unit 10, an analog/digital (A/D) converter unit 20, a processor unit 30, an alarm unit 40, an operating unit 50 and a power supply 60. The image capturing unit 10, the A/D converter unit 20, the processor unit 30 and the alarm unit 40 are connected in series. The operating unit 50 and the power supply 60 are both electronically connected to the processor unit 30.

The image capturing unit 10 is used to capture image of smoke in the ambient environment of the portable electronic device 100 and generate corresponding image signals. Understandably, the image capturing unit 10 can be a conventional digital camera module. The A/D converter unit 20 can be a conventional A/D converter circuit, which is used to convert the image signals output from the image capturing unit 10 into digital signals. The processor unit 30 can be a central processing unit (CPU) of the portable electronic device 100. In use, the processor unit 30 controls the image capturing unit 10 and the alarm unit 40. The alarm unit 40 can be a speaker, a light emitting diode (LED), a vibrator, etc. The alarm unit 40 is used to alarm the user. The operating unit 50 can be a keypad or a touch panel of the portable electronic device 100 used to operate the portable electronic device 100. The power supply 60 can be a conventional battery of the portable electronic device 100 used to provide working electric power to the portable electronic device 100.

Figure 2:
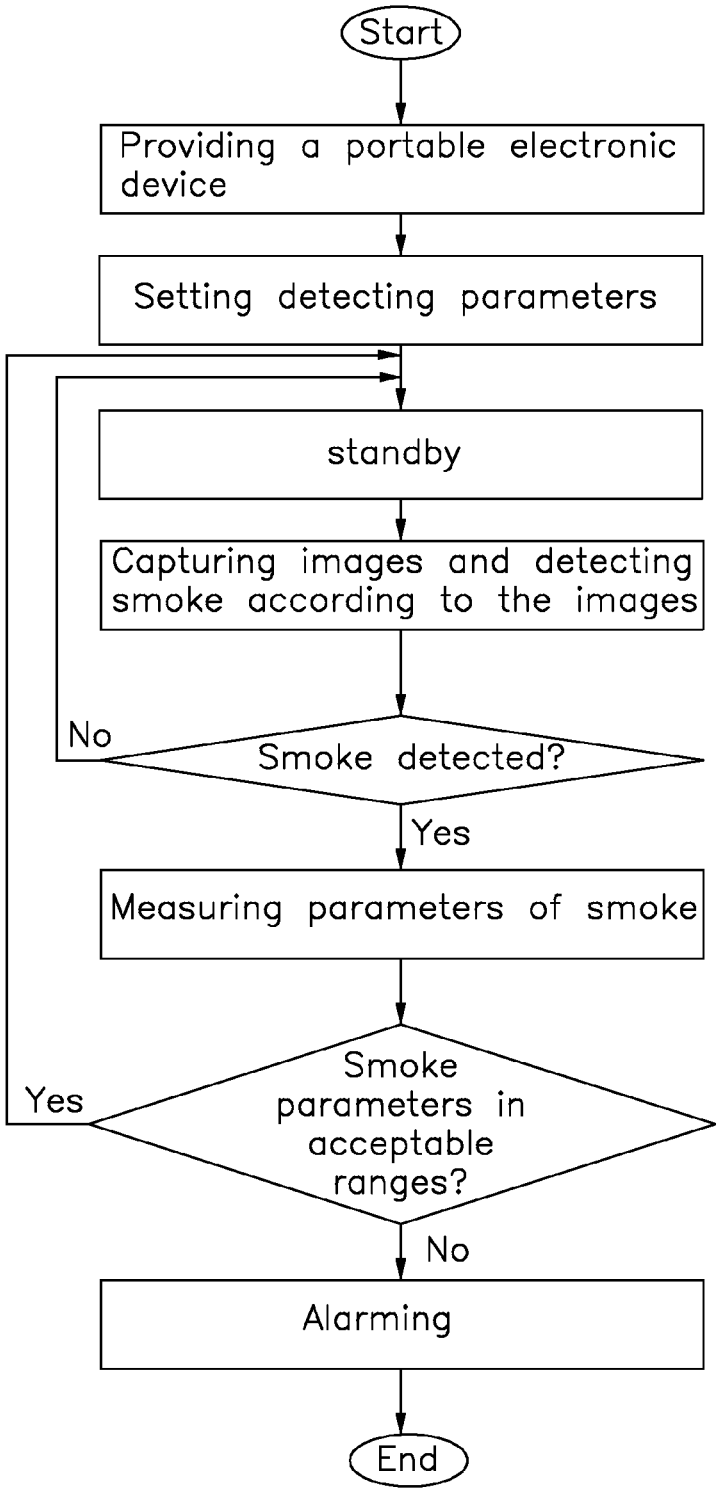
FIG. 2 is a flow chart of a smoke detecting method, according to an exemplary embodiment.

Referring to FIG. 2, a smoke detecting method according to an exemplary embodiment (i.e., using the portable electronic device 100) is shown. The smoke detecting method includes the steps as follows.

First, an aforementioned portable electronic device 100 is provided and switched on.

Detecting parameters, such as image capturing frequency of the image capturing unit 10, acceptable ranges of smoke thickness (e.g., obtained from the color of captured smoke) and smoke diffusing speed, are set via the operating unit 50 and stored in the processor unit 30. The processor unit 30 enters a standby status.

The image capturing unit 10 is switched on via the operating unit 50 and automatically captures images in a predetermined frequency or at predetermined time intervals, thereby generating corresponding image signals. The image signals are converted into digital signals by the A/D converter unit 20 and are transmitted to the processor unit 30.

When the standby processor unit 30 receives digital signals corresponding to an image captured by the image capturing unit 10, it analyzes the image according to the digital signals and then detects if there is any smoke in the ambient environment of the portable electronic device 100 captured by the image capturing unit 10 and shown in the image. If the processor unit 30 does not detect any smoke in the image, it returns to the standby status.

When the processor unit 30 detects smoke shown in a captured image, it analyzes relative parameters (e.g., color of smoke) according to the digital signals corresponding to the image. Furthermore, when the processor unit 30 detects smoke shown in consecutive images, it can further analyze other relative parameters (e.g., diffusing speed of smoke) from the consecutive images. If all parameters of smoke detected in the images within acceptable ranges, the processor unit 30 resumes to standby. When at least one parameter exceeds the predetermined acceptable ranges, the processor unit 30 controls the alarm unit 40 to alarm. The alarm signals can be audible sound, visual flashing, vibration, etc. Understandably, the processor unit 30 can also immediately control the alarm unit 40 to alarm when detecting smoke.

The present portable electronic device 100 has the function of automatically detecting smoke and alarming. Compared with conventional smoke detecting and alarming systems, the portable electronic device 100 is easy to carry, and can detect smoke at any moment and anywhere.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A portable electronic device, comprising:

an image capturing unit;

a processor unit connected to the image capturing unit; and an alarm unit connected to the processor unit;

wherein the image capturing unit captures outside images, the processor unit detects if there is any smoke near the portable electronic device according to the images and measures relative parameters of detected smoke, and the alarm unit generates an alarm when at least one parameter of the detected smoke is out of predetermined acceptable ranges; and wherein the processor unit measures at least thickness and diffusing speed of the detected smoke.

2. The portable electronic device as claimed in claim 1, further comprising an A/D converter unit connected between the image capturing unit and the processor unit for converting image signals generated by the image capturing unit into digital signals to be transmitted to the processor unit.

3. The portable electronic device as claimed in claim 1, further comprising an operating unit connected to the processor unit for operating the portable electronic device.

4. The portable electronic device as claimed in claim 3, wherein the image capturing frequency of the image capturing unit is set by the operating unit and stored in the processor unit.

5. The portable electronic device as claimed in claim 1, wherein the alarm unit is any one selected from a speaker, an LED and a vibrator.

6. A smoke detecting method, comprising the steps of:

providing a portable electronic device including an image capturing unit, a processor unit connected to the image capturing unit, and an alarming unit connected to the processor unit;

setting detecting parameters and storing the detecting parameters in the processor unit, wherein the detecting parameters include at least image capturing frequency, acceptable ranges of smoke thickness, and smoke diffusing speed;

using the image capturing unit to capture outside images in a predetermined frequency;

using the processor unit to detect if there is any smoke near the portable electronic device according to the images captured by the image capturing unit; and using the alarm unit to generate an alarm when smoke is detected in the images.

7. The method as claimed in claim 6, further comprising a step of switching the processor unit to standby after storing the parameters therein.

8. The method as claimed in claim 7, further comprising a step of resuming the processor unit to standby when no smoke is detected.

9. The method as claimed in claim 7, further comprising a step of measuring the detecting parameters of detected smoke.

10. The method as claimed in claim 9, further comprising a step of resuming the processor unit to standby when the detecting parameters of the detected smoke are in predetermined acceptable ranges.

11. The method as claimed in claim 9, further comprising a step of using the alarming unit to alarm when at least one detecting parameter of the detected smoke is out of predetermined acceptable ranges.

12. The method as claimed in claim 6, further comprising a step of converting the images captured by the image capturing unit into digital signals and transmitting the digital signals to the processor unit.

13. A portable electronic device, comprising:

an image capturing unit;

a processor unit connected to the image capturing unit;

an alarm unit connected to the processor unit; the image capturing unit capturing outside images, and the processor unit detecting if there is any smoke near the portable electronic device according to the images and measuring relative parameters of detected smoke, and the alarm unit generating an alarm when at least one parameter of the detected smoke is out of predetermined acceptable ranges; and an operating unit connected to the processor unit for operating the portable electronic device; wherein an image capturing frequency of the image capturing unit is set by the operating unit and stored in the processor unit.

14. The portable electronic device as claimed in claim 13, further comprising an A/D converter unit connected between the image capturing unit and the processor unit for converting image signals generated by the image capturing unit into digital signals to be transmitted to the processor unit.

15. The portable electronic device as claimed in claim 13, wherein the processor unit measures at least thickness and diffusing speed of the detected smoke.

16. The portable electronic device as claimed in claim 13, wherein the alarm unit is any one selected from a speaker, an LED and a vibrator.

* * * * *